US005745949A

United States Patent [19]

Pine

[11] Patent Number: 5,745,949

[45] Date of Patent: May 5, 1998

[54] BACK APPLICATOR CONTAINER

[76] Inventor: Eli S. Pine, 370 River Rd., Nutley, N.J. 07110

[21] Appl. No.: 557,817

[22] Filed: Nov. 14, 1995

[51] Int. Cl.[6] ..... A47K 7/03; A46B 5/02; B65D 85/00

[52] U.S. Cl. ..... 15/244.1; 15/104.94; 15/222; 206/229; 206/361; 401/8

[58] Field of Search ..... 15/104.94, 222, 15/244.1, 244.4; 401/6, 8, 207; 206/229, 210, 361, 572, 812

[56] References Cited

U.S. PATENT DOCUMENTS

| | | | |
|---|---|---|---|
| 2,691,787 | 10/1954 | Rosenwein | 15/222 X |
| 3,161,903 | 12/1964 | Worthington | 15/244.1 X |
| 3,463,302 | 8/1969 | Preston | 15/104.94 X |
| 3,750,219 | 8/1973 | MacConnell | 15/244.1 X |
| 3,860,348 | 1/1975 | Doyle | 401/6 |
| 3,959,841 | 6/1976 | Horne | 15/104.94 |
| 4,187,575 | 2/1980 | Collins | 15/222 |
| 4,196,490 | 4/1980 | Jonzon | 15/222 |
| 4,381,766 | 5/1983 | Avolio . | |
| 4,411,040 | 10/1983 | Sharrow et al. | 15/244.1 X |
| 4,802,927 | 2/1989 | Barbour | 15/244.4 X |
| 4,896,984 | 1/1990 | Evans | 401/6 X |
| 4,906,118 | 3/1990 | Crooks | 401/8 X |
| 5,013,171 | 5/1991 | Almond, II | 401/8 X |
| 5,024,325 | 6/1991 | Gundlach | 206/229 |
| 5,035,523 | 7/1991 | Allinder | 401/8 X |
| 5,251,990 | 10/1993 | Vought et al. . | |
| 5,339,486 | 8/1994 | Persic, Jr. | 15/244.1 |
| 5,360,111 | 11/1994 | Arispe | 401/207 X |
| 5,431,098 | 7/1995 | Winston | 15/244.1 X |

*Primary Examiner*—Bryon P. Gehman
*Attorney, Agent, or Firm*—Walter J. Tencza, Jr.

[57] ABSTRACT

This apparatus includes a sponge-like material approximately 2×3×0.5 inches, impregnated with a lotion, such as sun-tan lotion, in the middle of a length of cloth-like material of about 4 ft. by 2 inches in width. This comes in a leak proof container and is used to apply said lotion to the part of ones back difficult to reach by oneself. One grasps each end, flips it over the head and rubs in a side-to-side buffing motion.

7 Claims, 1 Drawing Sheet

BACK APPLICATOR CONTAINER

BACKGROUND

1. FIELD OF INVENTION

This invention relates to an efficient and convenient method of self-applying a substance to the part of ones back that is awkward or not possible to reach without the aid of a long-handled device. Specifically it is a strip of cloth-like material with sponge-like material in the middle impregnated with, for example, sun tan lotion. The cloth is long enough to enable both hands to grasp each end and rub against the small of ones back in a buffing motion, applying lotion by oneself to all parts of the back. Upon finishing applying the substance, the cloth is rolled around the sponge and replaced in a container from which it came.

BACKGROUND

2. DESCRIPTION OF PRIOR ART

The use of long handled brushes and towels to reach ones back has been used for centuries. When there is no one else to apply lotion to ones back on the beach it is not convenient or satisfactory to use a long handled item to apply sun-tan lotion or a towel for that purpose. Similarly the soaping of the small of ones back in the shower presents the same problem, as well as applying therapeutic substances to relieve back aches. In spite of the universality of the problem, people have had to wait for another person to come and apply lotions or do without. This inventor knows of no prior art that resolves this problem satisfactorily.

SUMMARY OF THE INVENTION

It is the object of this invention to provide a simple, inexpensive, and convenient apparatus that allows one to apply lotions of various sorts, such as sun-tan lotion, to the part of ones back that is not possible to reach otherwise. It consists of a cloth-like material of about four feet in length and about two inches in width that comes in a leak-proof packet. In the center of the length of cloth is a sponge-like material fastened thereto, measuring about two inches by three inches. This sponge-like material is impregnated by a lotion such as sun-tan lotion, soap, or therapeutic substances such as "Ben Gay" or "Mineral Ice". One grasps an end with each hand, flips the loop over ones head, and proceeds to rub in a side-to-side motion the sponge-like material on ones back. The impregnated sponge-like material delivers the lotion to the back otherwise impossible to reach. After the application of the lotion the material is rolled up and put back into the packet. The packet can be made in disposable form.

OBJECTS AND ADVANTAGES

Accordingly, besides the objects and advantages described herein, several objects and advantages of the present invention are:

(a) the cloth-like material, with a patch of lotion-impregnated sponge, comes enclosed in a small, unobtrusive container or packet;

(b) the container or packet is sealable so that it is leak-proof;

(c) being thin and light, the cloth-like material measuring approximately 4 feet long by 2 inches wide, is convenient and easy to rub ones back in places not otherwise reachable;

(d) the sponge-like material yields lotion;

(e) the sponge-like material can have as much lotion added as necessary;

(f) the length of material is rolled and folded to fit into a small convenient container;

(g) the material and container can be disposable.

BRIEF DESCRIPTION OF DRAWINGS

The present invention will be more fully understood by the following description of drawings wherein.

In a variation.

DESCRIPTION OF THE PREFERRED EMBODIMENT

Figure 1:
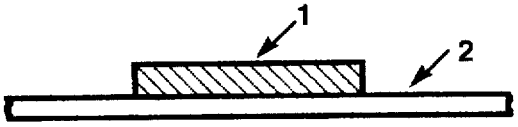
FIG. 1 is a side view the the sponge-like material fastened on top of the cloth-like material. This sponge-like material is impregnated with sun-tan lotion, soap, or various therapeutic lotions.
Figure 2:
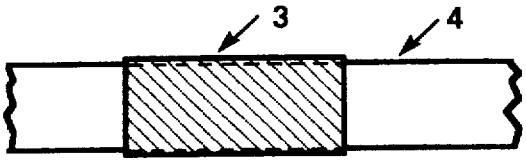
FIG. 2 is a top view of said same.
Figure 3:
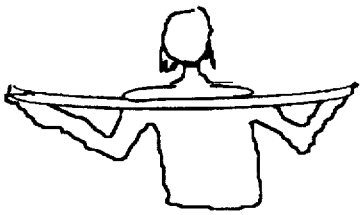
FIG. 3 shows how a person would apply said lotion(s) to the small of ones back.
Figure 4:
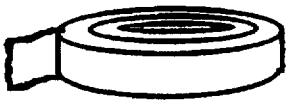
FIG. 4 shows said material rolled for a container.
Figure 5:
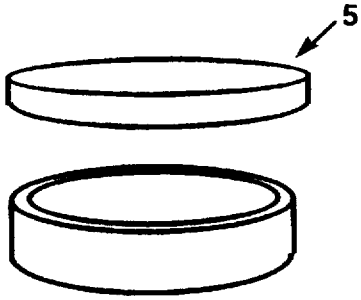
FIG. 5 and FIG. 6.
Figure 6:
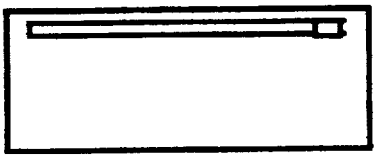
Figure 7:
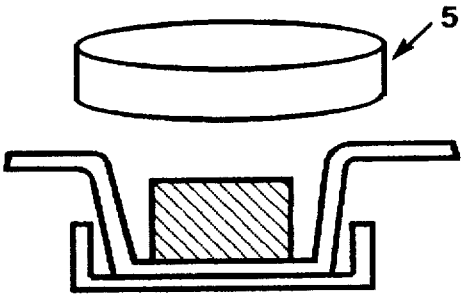
FIG. 7 shows a side view of the sponge and cloth fastened to one side of the container.

The object of this invention is to enable a person to apply various lotions to the part of ones back that cannot be reached by oneself. This invention fulfills this objective in an inexpensive, sanitary, and "easy to use" manner. In FIG. 1 the sponge-like material, hereafter called "sponge", member 1, is impregnated with a lotion such as sun-tan lotion, soap, therapeutic substances such as Mineral Ice, Ben Gay, aspirin-type lotions, and the like. A person can add as much lotion on the sponge as desired. The sponge can also be washed clean and hygienic to be reused. Member 2 is a cloth-like material, hereafter called "cloth", measuring approximately four feet in length by two inches in width. FIG. 3 shows how one grasps the ends of the cloth, flips it over the head, and proceeds to rub in a side-to-side buffing motion the said lotion onto the part of the back impossible to reach by ones own hands. This invention, unlike devices such as a long-handled brush, is very small, virtually weightless, easy to pocket, and eminently useful in a beach setting. FIG. 4 shows how the cloth and sponge are rolled, or folded. A leak-proof container is shown in FIGS. 5 and 6. Member 5 is the container cover. FIG. 7 shows a variation of the invention in that the cloth and the sponge are both affixed to the bottom of one half of the container so that a minimum of the lotion gets on ones hands.

I claim:

1. An apparatus comprised of:

a container comprised of a bottom, sides extending upwardly from the bottom, and a cover;

a sponge affixed to the bottom of the container, the sponge extending above the sides of the container;

wherein the bottom and the cover of the container can be combined together to substantially enclose the sponge within the container and further comprised of:

a cloth material of a sufficient length to encompass the back and shoulders of an average person;

the cloth material having a first end, a second end, and a middle;

wherein the bottom of the container is connected to the cloth material at a location near the middle of the cloth material.

2. The apparatus of claim 1 wherein:

the cloth material is substantially rectangular in shape.

3. The apparatus of claim 1 wherein:

the cloth material has a length of about four feet.

4. The apparatus of claim 1 wherein:

the cloth material is a substantially flexible material.

5. The apparatus of claim 1 wherein the sponge is affixed to the bottom of the container through the cloth material.

6. The apparatus of claim 1 wherein the cloth material is an expandable material.

7. The apparatus of claim 6 wherein the cloth material is comprised of a stretch fabric.

* * * * *